US007044862B1

(12) United States Patent
Scripps

(10) Patent No.: US 7,044,862 B1
(45) Date of Patent: May 16, 2006

(54) BOWLING PIN CARPET COVER TO A PIT CARPET

(76) Inventor: William J. Scripps, 9980 W. 178th St., Lakeville, MN (US) 55044

( * ) Notice: Subject to any disclaimer, the term of this patent is extended or adjusted under 35 U.S.C. 154(b) by 0 days.

(21) Appl. No.: 10/969,807

(22) Filed: Oct. 20, 2004

Related U.S. Application Data

(60) Provisional application No. 60/512,644, filed on Oct. 20, 2003.

(51) Int. Cl.
*A63D 5/00* (2006.01)

(52) U.S. Cl. ..... 473/73; 473/93

(58) Field of Classification Search ..... 473/54, 473/73, 93, 94, 106, 114; 428/53, 77, 78, 428/79, 99, 100
See application file for complete search history.

(56) References Cited

U.S. PATENT DOCUMENTS 4,931,344 A * 6/1990 Ogawa et al. ..... 428/100
5,447,473 A * 9/1995 Scripps ..... 473/73
6,444,595 B1 * 9/2002 Elkouh et al. ..... 442/76
2001/0001283 A1 * 5/2001 Kennedy et al. ..... 428/100
2001/0017017 A1 * 8/2001 Pacione ..... 52/506.05

OTHER PUBLICATIONS

Quality Brunswick, "Pit Cushion Parts",internet catalog, http://www.brunswickbowling.com/uploads/DocumentManager/1574_222_1086101221/quality _14-32.pdf, pp. 25 and 28-30, 1999.*

* cited by examiner

*Primary Examiner*—William M. Pierce
(74) *Attorney, Agent, or Firm*—Richard C. Conover

(57) ABSTRACT

The present invention is directed to apparatus for use with a bowling pin setting apparatus having a shaker board, pit rug and a carpet cover having a Velcro hook connecting material secured to the bottom side thereof. This apparatus includes a sheet of plastic material sized to cover the pit rug. A Velcro hook connecting material is secured on the bottom side of the sheet and a Velcro loop connecting material is secured on the top side of the sheet. When the sheet of plastic material is positioned on the pit rug, the hook material secured to the sheet releasably secures the sheet to the pit rug and when the carpet cover is positioned on the sheet the hook material of the carpet cover releasably secures the carpet cover to the loop material secured to the sheet.

3 Claims, 2 Drawing Sheets

BOWLING PIN CARPET COVER TO A PIT CARPET

This application claims the benefit of a provisional application Ser. No. 60/512,644, filed on Oct. 20, 2003.

BACKGROUND OF THE INVENTION

Bowling alley equipment includes a shaker board upon which the bowling pins sit. When the balls and pins fall on this shaker board, they are reprocessed back up into the pin setter equipment for setting the pins for a new bowler. The shaker board is covered with a pit carpet or rug which in turn is often covered with a carpet cover for cleaning lane oil and dirt off the balls and pins. This carpet cover is often laundered weekly. With the advent of reactive resin bowling balls and a heavier use of lane oil to increase scoring, a problem has evolved because the pit carpets are now wearing out much faster. Today, many mechanics in bowling centers are starting to cover their pit carpets with thick sheets of synthetic materials to protect them. The problem with this is that they can no longer use carpet covers because the conventional carpet covers have Velcro for attaching to the pit carpet, and with the synthetic sheet, there is nothing the Velcro can cling to.

The present invention solves this problem by providing apparatus for connecting a conventional carpet cover to the synthetic sheets covering the pit carpet.

SUMMARY OF INVENTION

The present invention is directed to apparatus for use with a bowling pin setting apparatus having a shaker board, pit rug and a carpet cover having a Velcro hook connecting material secured to the bottom side thereof. This apparatus includes a sheet of plastic material sized to cover the pit rug. A Velcro hook connecting material is secured on the bottom side of the sheet and a Velcro loop connecting material is secured on the top side of the sheet. When the sheet of plastic material is positioned on the pit rug, the hook material secured to the sheet releasably secures the sheet to the pit rug and when the carpet cover is positioned on the sheet the hook material of the carpet cover releasably secures the carpet cover to the loop material secured to the sheet.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
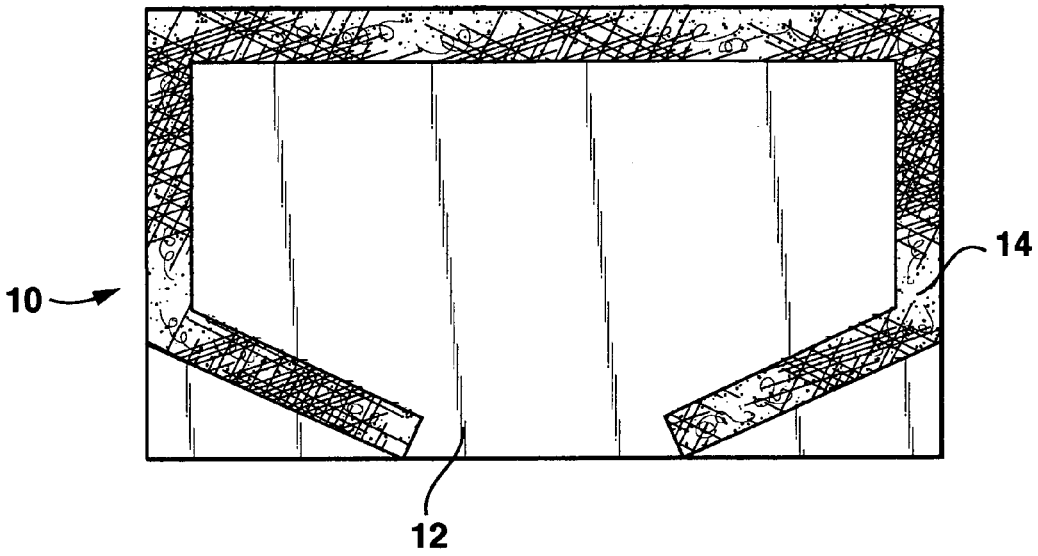
FIG. 1 is a top view photograph of a sheet to which Velcro loop material is sewn in accordance with the present invention.
Figure 2:
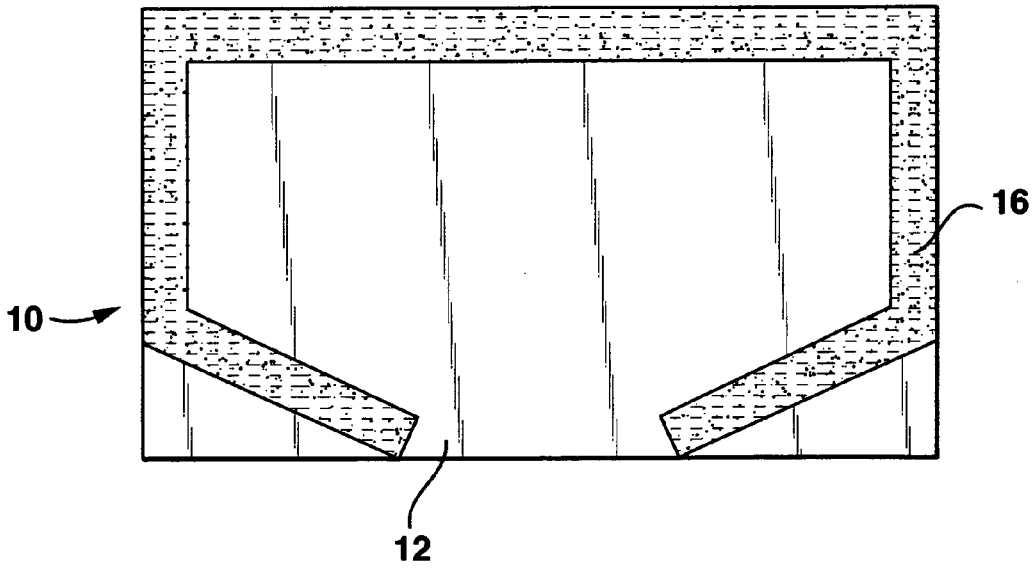
FIG. 2 is a bottom view photograph of the sheet shown in FIG. 1 to which Velcro hook material is sewn.

The apparatus 10, according to the present invention, is shown in FIGS. 1 and 2. The apparatus 10 includes a sheet 12 of poly vinyl chloride material approximately ⅛" thick, although other plastic sheets and other thicknesses could be used equally as well. FIG. 1 shows a top view of the sheet 12 with Velcro loop material 14 sewn to sheet 12 in the manner shown. FIG. 2 shows the underside of the sheet 12 with a strip of Velcro hook material 16 sewn to the sheet 12, as shown.

Figure 3:
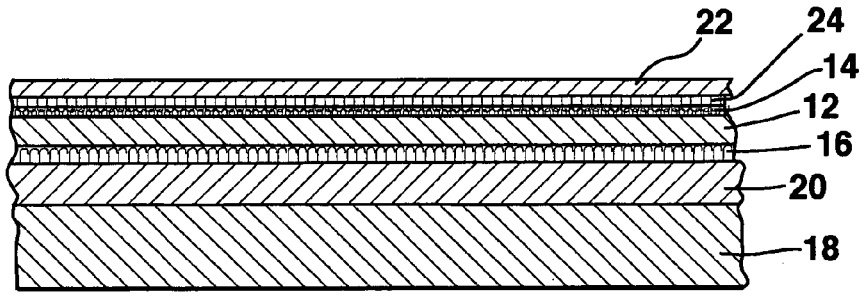
FIG. 3 is a cross-sectional view of the present invention installed over a pit rug covering a shaker board.

In use, the invention 10 is installed as shown in FIG. 3 showing a cross-sectional view of the apparatus 10 installed above a conventional shaker board 18. A pit rug 20 is secured to the shaker board 18 in a conventional manner. The sheet 12 is then placed on top the pit rug with the Velcro hook material 16 clinging to the pit rug 20. A conventional carpet cover 22 includes Velcro hook material 24 and is positioned over sheet 12. The Velcro hook material 24 clings to the Velcro loop material 14 sewn to the sheet 12. In a preferred embodiment a strip of Velcro loop material 14 and a strip of Velcro hook material 16 is provided. Each strip has a portion secured to the sheet adjacent a peripheral edge of the sheet as shown in FIGS. 1 and 2.

Figure 4:
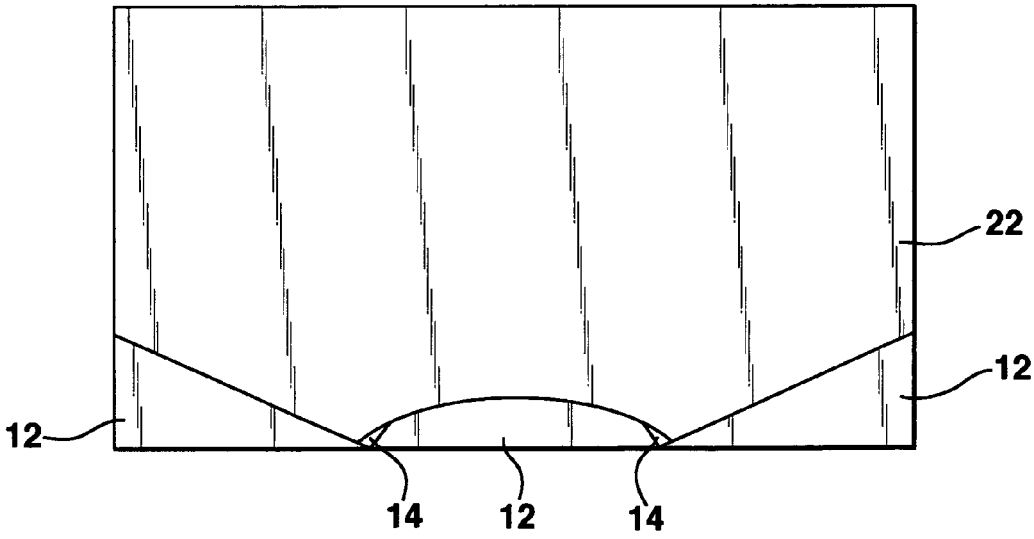
FIG. 4 is a top view photograph of a carpet cover secured to the sheet shown in FIG. 1.

In this manner, the carpet cover may be secured to the synthetic material protecting the pit rug, solving a problem which has been well known in the art. FIG. 4 shows a carpet cover 22 mounted to the sheet 12, as described above.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. Apparatus for use with a bowling pin setting apparatus comprising:

a fabric pit rug upon which bowling pins are collected;

a carpet cover for keeping the pit rug clean having a hook connecting material secured to a bottom side thereof;

a sheet of plastic material sized to cover the pit rug;

a hook connecting material secured on the bottom side of the sheet;

a loop connecting material secured on the top side of the sheet;

whereby when the sheet of plastic material is positioned on the pit rug, the hook material secured to the sheet releasably secures the sheet to the pit rug and when the carpet cover is positioned on the sheet, the hook material of the carpet cover releasably secures the carpet cover to the loop material secured to the sheet.

2. The apparatus according to claim 1 wherein the hook connecting material secured to the bottom side of the sheet comprises a strip of such material, a portion of which is secured to the sheet adjacent a peripheral edge of the sheet.

3. The apparatus according to claim 1 wherein the loop connecting material is secured to the top side of the sheet comprises a strip of such material, a portion of which is secured to the sheet adjacent a peripheral edge of the sheet.

* * * * *